US012049810B2

(12) United States Patent
Debergé et al.

(10) Patent No.: US 12,049,810 B2
(45) Date of Patent: Jul. 30, 2024

(54) FACILITY AND METHODS FOR OPERATING A MINE BY IN-SITU LEACHING

(71) Applicant: Orano Mining, Chatillon (FR)

(72) Inventors: Adrien Debergé, L'Hay les Roses (FR); Julie Sanchez Vado, Pont Saint-Esprit (FR)

(73) Assignee: FRAMATOME, Courbevoie (FR)

( * ) Notice: Subject to any disclaimer, the term of this patent is extended or adjusted under 35 U.S.C. 154(b) by 398 days.

(21) Appl. No.: 17/294,040

(22) PCT Filed: Nov. 13, 2019

(86) PCT No.: PCT/EP2019/081163
§ 371 (c)(1),
(2) Date: May 14, 2021

(87) PCT Pub. No.: WO2020/099480
PCT Pub. Date: May 22, 2020

(65) Prior Publication Data

US 2022/0003101 A1 Jan. 6, 2022

(30) Foreign Application Priority Data

Nov. 14, 2018 (FR) ..... FR 18 60494

(51) Int. Cl.
*E21B 43/28* (2006.01)
*E21B 33/068* (2006.01)

(52) U.S. Cl.
CPC ..... *E21B 43/28* (2013.01); *E21B 33/068* (2013.01)

(58) Field of Classification Search
CPC ..... E21B 43/28; E21B 33/068; E21B 43/40
See application file for complete search history.

(56) References Cited

U.S. PATENT DOCUMENTS 3,915,499 A 10/1975 Mallon et al.
4,071,278 A 1/1978 Carpenter et al.
4,103,963 A 8/1978 Espenscheid et al.
4,155,982 A 5/1979 Hunkin et al.
(Continued)

FOREIGN PATENT DOCUMENTS

CA 1064816 A 10/1979

OTHER PUBLICATIONS

Corresponding Search Report for PCT/EP2019/081163.
Corresponding Search Report for FR1860494.

*Primary Examiner* — Carib A Oquendo
(74) *Attorney, Agent, or Firm* — Davidson Kappel LLC

(57) ABSTRACT

An operating facility (1) for operating a mine by in-situ leaching comprises a supply manifold (9) for supplying leach liquor to the injector well heads (3), a production manifold (15) configured to discharge leachate to a leachate treatment plant (17), a treatment manifold (19), a facility (20) for providing a treatment solution configured to inject the treatment solution into the treatment manifold (19) and/or into the supply manifold (9); and for each producing well, a production pipe (21) equipped with a production cut-off device (25) and a treatment pipe (23) equipped with a treatment cut-off device (27), fluidically connecting the corresponding producing well head (5) in parallel, respectively, to the production manifold (15) and to the treatment manifold (19).

13 Claims, 4 Drawing Sheets

(56) References Cited

U.S. PATENT DOCUMENTS

| | | | | | |
|---|---|---|---|---|---|
| 4,358,158 | A * | 11/1982 | Showalter | C22B 3/06 | 299/4 |
| 4,547,019 | A | 10/1985 | Warzel | | |
| 4,572,581 | A * | 2/1986 | Horton | E21B 43/28 | 299/5 |
| 4,575,154 | A | 3/1986 | Mays | | |
| 4,586,752 | A * | 5/1986 | Showalter | E21B 43/28 | 166/400 |
| 2009/0236889 | A1 * | 9/2009 | Prause | B60N 2/6671 | 297/284.8 |
| 2013/0171048 | A1 | 7/2013 | Phillip et al. | | |

* cited by examiner

FACILITY AND METHODS FOR OPERATING A MINE BY IN-SITU LEACHING

The present disclosure relates in general to the operation of mines by in situ leaching, particularly uranium mines.

BACKGROUND

In situ leaching of ores, also known as "In Situ Leaching" or the ISL method, is a mining method that consists of:

- establishing a circulation of a leach solution in the base of the deposit capable of selectively dissolving the mineral element to be mined
- pumping the leach solution loaded with the mineral element of interest to surface treatment facilities, where the valuable mineral element is separated and concentrated into a marketable product;
- recycling the leach solution back to the deposit, after reconditioning.

The ISL method is particularly applied to low-grade uranium, copper or gold deposits. It has the advantage that the selective dissolution of the mineral element from its gangue is done without physically moving the mineral and without significantly modifying the host rock (generally a sandy and porous medium).

For uranium, the solution injected to dissolve the mineral element is, for example, an alkaline solution of sodium carbonate or bicarbonate, which allows for a progressive and fairly selective dissolution. In a variant, the leach liquor is an acid solution, usually sulfuric, for a more aggressive and faster but less selective dissolution.

The leach solution, also called the leach liquor, is generally injected under pressure into a permeable horizon containing the mineral to be treated. The leach solution is injected through a network of injector wells that descend to the permeable horizon. In this way, the leach solution is put into contact with the mineral element to be dissolved.

A second network of wells, called producing wells, inserted in the above network, pumps the mineralized leach solution and sends it to a facility installed on the surface for a conventional extraction treatment of the mineral element in the liquid phase.

After treatment, the leaching power of the solution is regenerated. The solution can be re-injected into the injector well network a large number of times, for example between ten and more than fifty times.

It may be necessary to perform non-standard chemical treatments of the wells, particularly the producing wells.

In this case, it is possible to transport the chemicals used for the treatment by truck, and to connect the truck's tank directly to the well head to be treated.

This requires a significant amount of preparation time, as the connection and disconnection times are long. Moreover, these operations must be performed by specialized operators, who are not always available.

SUMMARY

In this context, the present disclosure aims at providing a facility and a method for operating that do not have the above defects.

To this end, an in-situ leach mining facility is provided comprising:

- a plurality of injector well heads, each configured to inject a leach liquor into the corresponding injector well;

- a plurality of producing well heads, each configured to selectively collect leachate going up the corresponding producing well or to inject a treatment solution into the corresponding producing well; and
- a supply manifold for supplying leach liquor to the injector well heads, configured to be connected on the upstream side to a leach liquor supply facility, the supply manifold for supplying the injector well heads being fluidly connected to each injector well head;
- a production manifold, configured to discharge leachate to a leachate treatment plant;
- a treatment manifold;
- a facility for providing a treatment solution, configured to inject the treatment solution into the treatment manifold and/or into the supply manifold;
- for each producing well, a production pipe and a treatment pipe, fluidically connecting the corresponding producing well head in parallel, respectively, to the production manifold and to the treatment manifold, the production pipe being equipped with a production cut-off device capable of selectively authorizing or prohibiting the circulation of fluid between the producing well head and the production manifold, the treatment pipe being equipped with a treatment cut-off device capable of selectively authorizing or prohibiting the circulation of fluid between the producing well head and the treatment manifold.

Thus, in order to carry out the treatment of a producing well, it is sufficient to activate the facility for providing the treatment solution, and to place the production cut-off and treatment units of the various producing wells in the appropriate positions. The treatment solution is injected into the producing well via the treatment manifold and the appropriate treatment pipe. No assembly or disassembly operations are required on the producing well head, which contributes to limiting the risk of accidents for the operators.

The producing well to be treated is easily selected by placing the production cut-off and treatment units in the appropriate configuration.

This operation can be performed by non-specialized operators.

The treatment of the injector wells is also very simple. The treatment product is distributed via the supply manifold, which is designed to direct the treatment product selectively to the appropriate injector well(s).

The operating facility may further comprise one or more of the following features, considered alone or according to all technically possible combinations:

- the facility for providing a treatment solution comprises a module for providing the treatment solution, fluidly connected to the treatment manifold;
- the supply module is mobile, the treatment manifold having a detachable connection by which the mobile supply module is capable of being fluidly connected in a detachable way to the treatment manifold;
- the facility for providing a treatment solution comprises an intermediate conduit, fluidly connecting the supply manifold to the treatment manifold, and equipped with an intermediate cut-off device capable of selectively authorizing or prohibiting the circulation of leach liquor in the intermediate conduit;
- the operating facility comprises a recirculation conduit fluidly connected to a downstream point of the treatment manifold and to an upstream point of the supply manifold, the intermediate conduit being connected to an upstream point of the treatment manifold, the treatment conduits of the producing wells being connected to intermediate points of the treatment manifold located between the upstream and downstream points;

the facility for providing a treatment solution comprises a further module for providing a treatment solution fluidly connected to the upstream supply manifold of the injector well heads;

the supply manifold of the injector well heads is fluidly connected to each injector well head by at least one supply conduit, the or each supply conduit being equipped with a supply cut-off device capable of selectively authorizing or prohibiting the circulation of fluid in the supply conduit.

According to a second aspect, the present disclosure relates to a method of operating the mining facility by in-situ leaching having the above features and comprising the following steps:

receiving the leach liquor coming from the leach liquor supply facility and feeding the leach liquor to the injector well head of at least one of the injector wells via the supply manifold;

collecting the leachate going up from at least one of the producing wells through the corresponding producing well head and discharging the leachate to the leachate treatment plant through the production manifold, the treatment cut-off device prohibiting the circulation of fluid between said producing well head and the treatment manifold.

According to a third aspect, the present disclosure relates to another method of operating an in-situ leach mining facility having the above features and comprising the following steps:

supplying the treatment manifold and/or the supply manifold with a treatment solution by the facility for providing a treatment solution;

injecting the treatment solution into at least one producing well and/or at least one injector well.

The operation method may further comprise one or more of the following features, considered alone or according to all technically possible combinations, wherein:

in the supply step, the treatment solution is supplied to the treatment manifold;

in the injection step, the treatment solution is injected into at least one producing well, the production cut-off device prohibiting the circulation of fluid between the corresponding producing well head and the production manifold, the treatment cut-off device authorizing the circulation of the treatment solution from the treatment manifold to the corresponding producing well head;

the supply module is fluidly connected to the treatment manifold and delivering the treatment solution;

the step of providing a treatment solution comprises:

receiving the leach liquor coming from the leach liquor supply facility through the supply manifold, and transferring some or all of the leach liquor through the intermediate conduit from the supply manifold to the treatment manifold, the intermediate cut-off device authorizing the circulation of the leach liquor in the intermediate conduit;

the method comprises a step of receiving the leach liquor coming from the leach liquor supply facility and supplying leach liquor to the injector well head of at least one of the injector wells via the supply manifold, concomitant with the steps for providing a treatment solution and injecting the treatment solution;

the method comprises a step of collecting the leachate going up from at least one other of the producing wells through the corresponding producing well head and discharging the leachate to the leachate treatment plant through the production manifold, concomitant with the steps for providing a treatment solution and injecting the treatment solution.

BRIEF SUMMARY OF THE DRAWINGS

Further features and advantages of the present disclosure will be apparent from the detailed description given below, by way of indication and not in any way limiting, with reference to the appended figures, of which.

Figure 1:
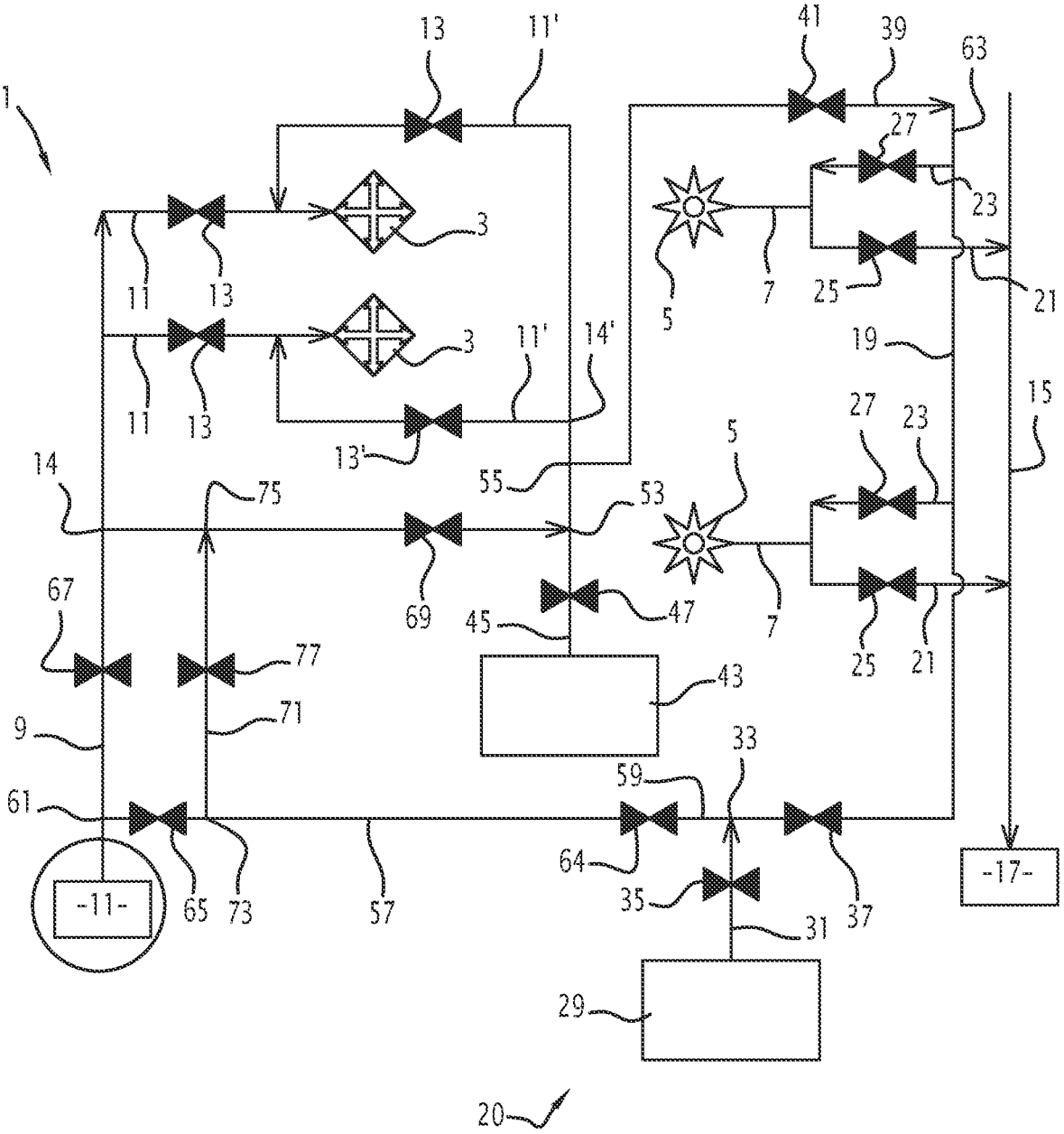
FIG. 1 is a simplified schematic representation of the operating facility according to the present disclosure.
Figure 2:
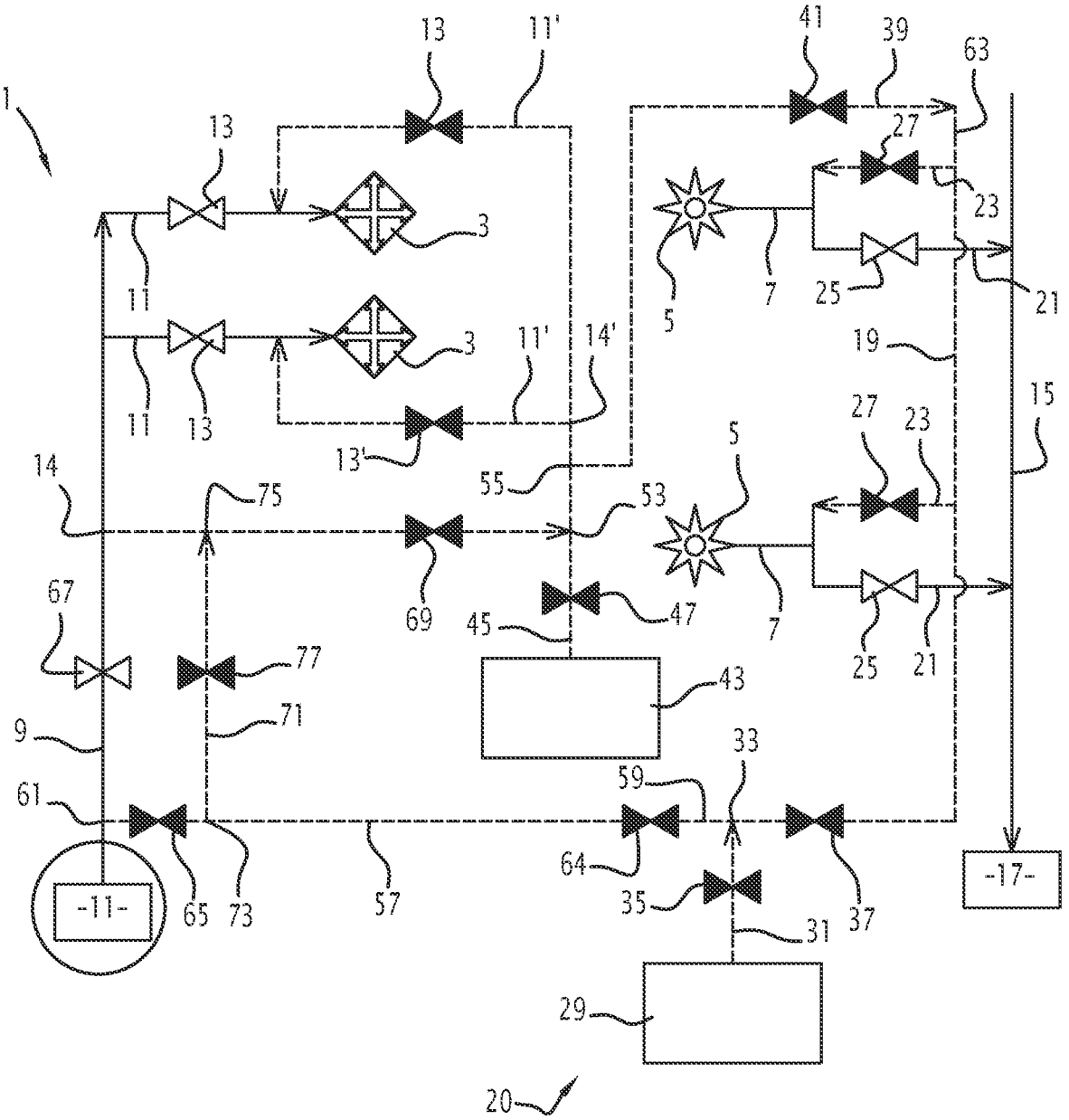
Figure 3:
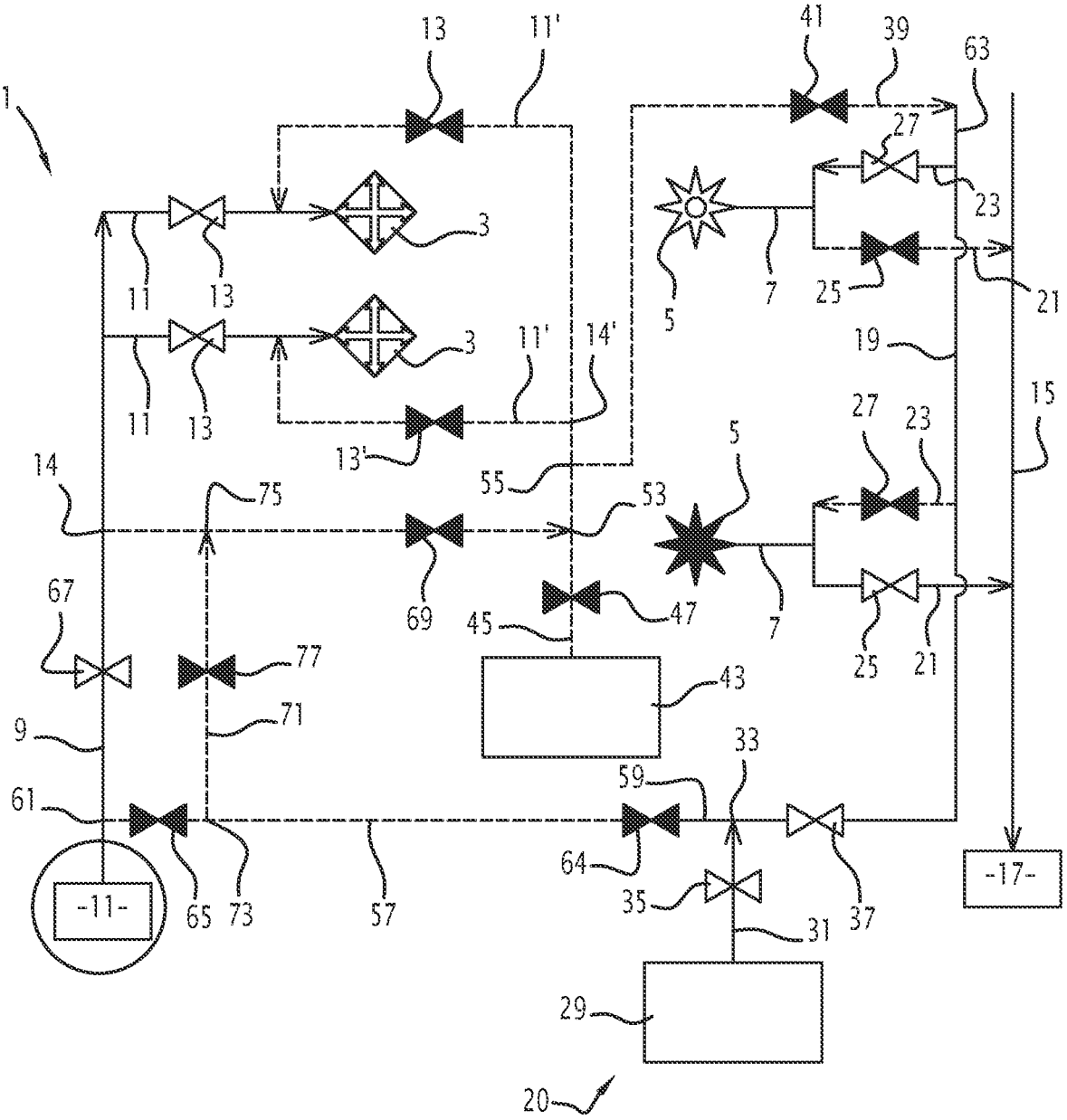
Figure 4:
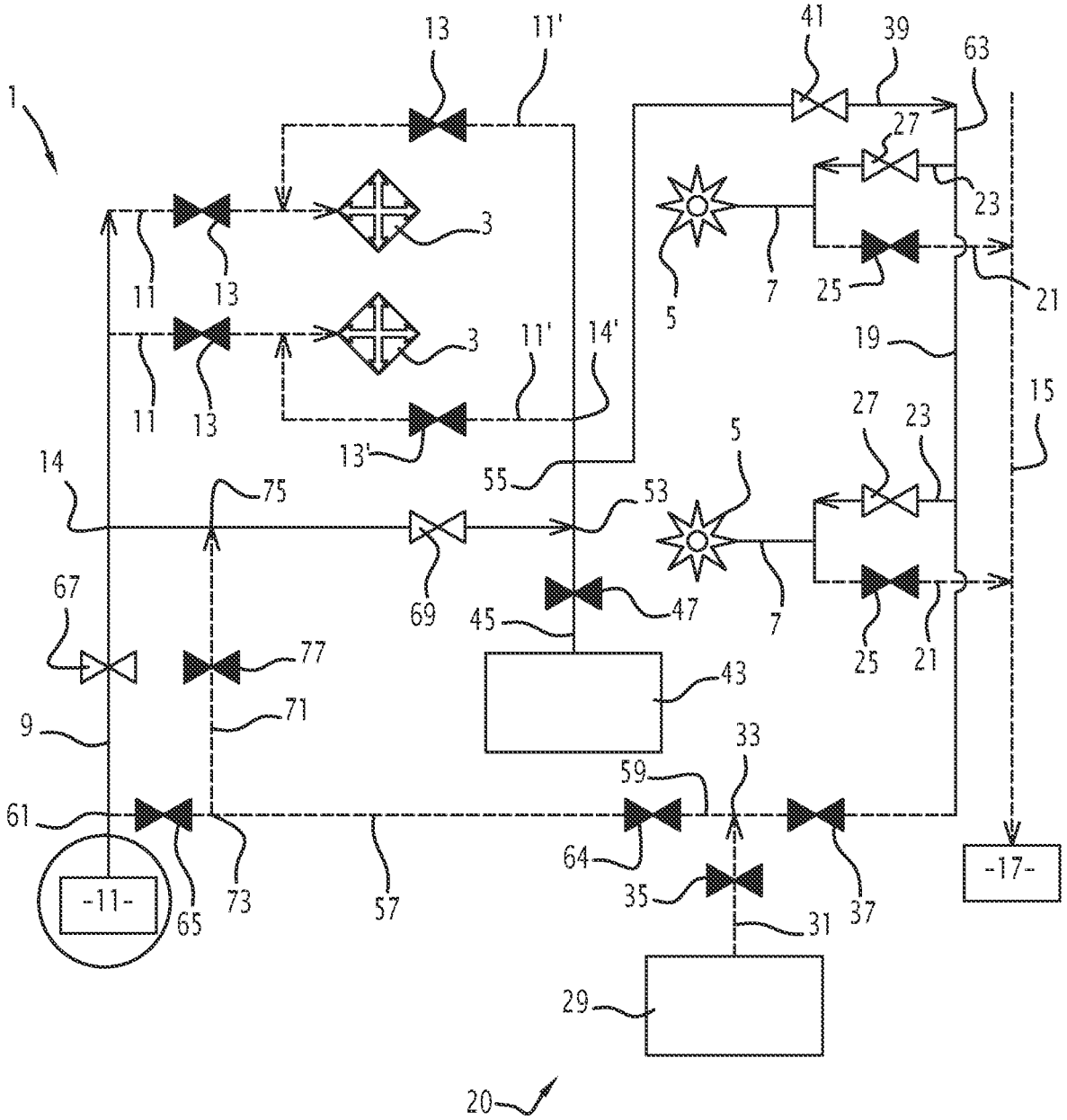

is a representation similar to that of FIG. 1, illustrating a situation wherein the facility is operated as a first method according to the present disclosure, this method corresponding to a normal production case;

FIG. 3 is a view similar to that of FIG. 2, illustrating a situation wherein the facility is operated as a batch treatment method of a producing well while the injector wells are in operation; and FIG. 4 is a view similar to that of FIG. 2, illustrating a situation wherein the facility is operated as a continuous treating method of producing wells while the injector wells are not in operation.

DETAILED DESCRIPTION

The facility 1 shown in FIG. 1 is intended for the operation of a mine by in situ leaching, particularly a uranium mine.

The facility 1 comprises:

a plurality of injector well heads 3, each arranged to inject leach liquor into the corresponding injector well;

a plurality of producing well heads 5.

In FIG. 1, only two injector well heads and two producing well heads have been shown. However, the operating facility 1 typically has a large number of injector well heads and a large number of producing well heads. For example, the facility has several dozen injector well heads and several dozen producing well heads.

The leach liquor is of any suitable type. When the mine is a uranium mine, the leach liquor is an acid solution, typically sulfuric acid. It contains for example two grams of acid per liter. In a variant, the leach liquor is an alkaline solution of sodium carbonate or bicarbonate.

As explained above, each injector well is configured to allow for the injection of the leach liquor up to a layer called the permeable mineralized horizon, containing the mineral element to be extracted. This layer is sandwiched between an impermeable roof and an impermeable wall, typically continuous clay layers.

Each producing well is configured to allow for the extraction of a leachate, comprising at least the leach liquor and the mineral element to be extracted. Each producing well sinks to the mineralized permeable horizon.

According to the present disclosure, each producing well head 5 is configured to selectively collect the leachate going up from the corresponding producing well or to inject a treatment solution into the corresponding producing well.

To do so, the producing well head 5 comprises, for example, a pump configured to pump leachate going up from the producing well, and a bypass conduit allowing for injecting the treatment solution by bypassing the pump.

The producing well head 5 also comprises an outlet pipe 7, connected to both the recovery pump and the bypass duct.

Preferably, a set of valves selectively allows the outlet pipe 7 to connect either to the backflow from the pump or to the bypass duct.

The mining operations facility 1 further comprises a manifold 9 for supplying the injector well heads 3 with leach liquor. The supply manifold 9 is connected on the upstream side to a leach liquor supply facility 11.

As illustrated in FIG. 1, the injector well head supply manifold 9 is fluidly connected to each injector well head 3.

More precisely, this supply manifold 9 is fluidly connected to each injector well head by a supply conduit 11, equipped with a supply cut-off device 13. This cut-off device is capable of selectively authorizing or prohibiting the supply of the injection well 3 with leach liquor from the supply conduit 9.

In the example embodiment shown in FIG. 1, the supply manifold 9 is fluidly connected to each injector well head 3 by, in addition to the supply conduit 11, a further supply conduit 11'. Each further supply conduit 11' is equipped with a further supply cut-off device 13'. The supply conduits 11 are connected to a first point 14 of the supply conduit 9. The supply conduits 11' are connected to a second point 14' of the supply manifold 9, located downstream of the first point 14.

In the present description, the term cut-off device typically refers to a valve, motorized or manual. In a variant, the cut-off device is of any other suitable type. The cut-off device is said to be open when it authorizes the circulation of fluid in the corresponding conduit and closed when it prohibits the circulation of fluid in the corresponding conduit.

The mining operations facility 1 further comprises a production manifold 15, configured to discharge the leachate enriched with the mineral element of interest in the leachate treatment plant 17.

In this treatment plant, the extracted mineral element is separated from the leach liquor. This is purified and possibly concentrated before being returned to the supply manifold 9.

The leachate treatment plant and the leach liquor supply facility are typically one and the same plant.

The mining operations facility 1 further comprises a treatment manifold 19, and a facility 20 for providing a treatment solution arranged to inject the treatment solution into the treatment manifold 19 and/or into the supply manifold 9.

Moreover, the mining operations facility 1 comprises, for each producing well 5, a production pipe 21 and a treatment pipe 23, fluidly connecting in parallel the producing well head 5 respectively corresponding to the production manifold 15 and to the treatment manifold 19.

The production and treatment pipes 21, 23 are typically both connected to the outlet pipe 7 of the producing well head 5.

The production pipe 21 is equipped with a production cut-off device 25 capable of selectively authorizing or prohibiting the circulation of fluid between the producing well head 5 and the production manifold 15.

The treatment pipe 23 is equipped with a treatment cut-off device 27, capable of selectively authorizing or prohibiting the circulation of fluid between the producing well head 5 and the treatment manifold 19.

Advantageously, the at least one facility 20 for providing a treatment solution comprises a treatment solution supply module 29, fluidly connected to the treatment manifold 19. It is directly connected to the treatment manifold 19.

The supply module 29 is preferably mobile.

As such, the treatment manifold 19 comprises a detachable connection 31, through which the mobile supply facility 29 is capable of being fluidly connected in a detachable way to the treatment manifold 19.

The treatment solution is of any suitable type.

When the treatment solution is intended to be injected into an injector well, the treatment solution is for example acid, typically sulfuric acid $H_2SO_4$. This acid is highly concentrated, much more concentrated than the leach liquor. For example, it has a concentration of about 30 grams of acid per liter.

In a variant, the treatment solution comprises an oxidant, for example $H_2O_2$ or a biooxidation solution.

When the treatment solution is to be injected into a producing well, this solution is for example an acid solution, typically sulfuric acid $H_2SO_4$. This acid is highly concentrated, significantly more concentrated than the leach liquor. For example, it has a concentration of about 30 grams of acid per liter. In a variant, the treatment solution is a solution of ammonium bifluoride or hydrofluoric acid.

The mobile supply module 29 is, for example, a truck. The detachable connection 31 is typically a self-sealing connection, of any suitable type.

The detachable connection 31 is fluidly connected to the treatment manifold 19 by a conduit 33 equipped with a cut-off device 35.

A cut-off device 37 is placed on the treatment manifold 19, between the connection point of the supply module 29 and the connection points of the treatment pipes 23.

In a variant, the supply module 29 is not movable but is permanently connected to the treatment manifold 19. The connection 31 is not detachable.

The facility 20 for providing a treatment solution also comprises an intermediate conduit 39 fluidly connecting the supply manifold 9 to the treatment manifold 19. The intermediate manifold 39 is equipped with an intermediate cut-off device 41 capable of selectively allowing or prohibiting the circulation of the leach liquor in the intermediate conduit 39.

Preferably, the facility 20 for supplying a treatment solution also comprises another module 43 for supplying a treatment solution, fluidly connected to the supply manifold 9 upstream of the injector well heads 3. It is directly connected to the supply manifold 9.

The term upstream is understood here to mean in the direction of circulation of the leach liquor.

The module 43 is typically provided to supply a concentrated acid solution.

It is connected to the supply manifold 9 by a conduit 45 equipped with a cut-off device 47. The other module for providing a treatment solution 43 is connected to a third point 53 of the supply manifold 9, located between the first and second points 14, 14'. Thus, depending on the respective positions of the cut-off devices 13 and 13', it is possible to supply each injector well head 3 only with leach liquor without adding a treatment product, or only with leach liquor with added treatment solution, or even partly with leach liquor without treatment solution and partly with leach liquor with added treatment solution.

It should be noted that the intermediate conduit 39 is connected to a fourth point 55 of the supply manifold 9 located downstream of the third point 53.

The operating facility 1 further comprises a recirculation conduit 57, fluidly connected to a downstream point 59 of the treatment manifold 19. The recirculation conduit 57 is also fluidly connected to an upstream point 61 of the supply manifold 9.

The intermediate conduit 39 is connected to an upstream point 63 of the treatment manifold 19. The points 14 and 14' for connecting the injector well heads 3 to the supply manifold are located downstream of the upstream point 61 of the supply manifold 9. The treatment pipes 23 of the producing wells are connected to points on the treatment manifold 19 located between the upstream and downstream points 63, 59.

Thus, the supply manifold 9, the intermediate conduit 39, the treatment manifold 19 and the recirculation conduit 57 form a loop in which it is possible to run a fluid in a closed circuit.

Cut-off devices 64 and 65 respectively isolate the recirculation conduit 57 from the treatment manifold 19 and the supply manifold 9. The cut-off devices 67 and 69 are arranged on the supply manifold 9 between the points 61 and 14 and between the points 14 and 53 respectively.

A bypass conduit 71 fluidly connects a point 73 of the recirculation conduit 57 to a point 75 of the supply manifold 9. The point 73 is located between the cut-off devices 64 and 65. The point 75 is located between the points 14 and 53. The conduit 71 is equipped with a cut-off device 77.

Various methods for operating for the mining operations facility 1 described above will now be detailed.

The first operation method is illustrated in FIG. 2 and corresponds to a normal production case, with injection of leach liquor into the injector wells and collection and discharge of the leachate from the producing wells to the treatment plant 17.

In FIGS. 2 to 4, inactive lines are shown as dashed lines. The active lines are shown as solid lines. The closed cut-off devices, which prohibit circulation in the corresponding lines, are shown as solid lines. The open cut-off devices, authorizing the circulation of fluid in the corresponding lines, are shown unfilled.

In this operation method, the facility 20 for supplying a treatment solution is inactive.

The method comprises the following steps:

- receiving the leach liquor coming from the leach liquor supply facility 11, and supplying the leach liquor to the injector well head 3 of at least one of the injector wells via the supply manifold 9;
- collecting the leachate coming up from at least one of the producing wells via the corresponding producing well head 5, and discharging the leachate to the leachate treatment plant 17 via the production manifold 15.

The cut-off device 67 authorizes the circulation of the leach liquor in the supply manifold 9. The leach liquor is supplied to the or each injector well head 3 only through the or each corresponding supply conduit 11, the corresponding supply cut-off device(s) 13 are open.

Typically, several injector well heads 3 are supplied, typically all injector well heads 3 are supplied.

In contrast, the injector well heads 3 are not supplied by the other supply conduits 11'. The cut-off devices 69 and 13' are closed.

Typically, the leachate coming up from several of the producing wells is collected. Advantageously, leachate from all the producing wells is collected.

The production cut-off device(s) 25 authorize the circulation of the leachate. The treatment cut-off devices 27, on the other hand, prohibit circulation in the conduits 23.

The following cut-off devices are all closed: cut-off devices 41, 35, 37, 64, 65, 77, 47.

According to a variant embodiment not shown, the leach liquor is acidified before being fed to the injector well head(s) 3.

In this variant embodiment, only the points that differ from the method shown in FIG. 2 will be detailed below.

In this case, the supply module 43 is in operation. The cut-off device 47 authorizes the supply of concentrated acid by the supply module 43 to the supply manifold 9.

The acidified leach liquor supplies the injector well head(s) 3 via the supply conduits 11'. The supply cut-off devices 13' authorize the circulation of the acidified leach liquor. The cut-off device 69 is open.

Typically, if all of the leach liquor is to be acidified, then the cut-off devices 13 are all closed. If only a portion of the leach liquor is to be acidified, then the cut-off device(s) 13 authorize the circulation of the leach liquor through one or more supply conduits 11, in parallel with the supply through the supply conduits 11'.

Another method for operating the mining operations facility 1 will now be described, with reference to FIGS. 3 and 4. In this method, a chemical treatment is applied to at least one producing well and/or at least one injector well.

The mining method comprises the following steps:

- supplying the treatment manifold 19 or the supply manifold 9 with a treatment solution from the treatment solution supply facility 20;
- injecting the treatment solution into at least one producing well, or into at least one injector well.

In the case where the treatment is applied to one or more producing wells:

- In the supply step, the treatment solution is supplied to the treatment manifold 19;
- In the injection step, the treatment solution is injected into at least one producing well. To do so, the production cut-off device 25 prohibits the circulation of fluid between the corresponding producing well head 5 and the production manifold 15, and the treatment cut-off device 27 authorizes the circulation of the treatment solution from the treatment manifold 19 to the corresponding producing well head 5.

According to a first embodiment, illustrated in FIG. 3, the treatment is a batch treatment.

In this case, the supply module 29 supplies the treatment solution to the treatment manifold 19.

In the case that this supply module 29 is a mobile supply module, it is fluidly connected to the treatment manifold 19 by the detachable connection 31.

In the example shown in FIG. 3, one or more producing wells are being treated together, while one or more other producing wells are in production. The treatment cut-off devices 27 of the producing well(s) prohibit the circulation of the treatment solution. In contrast, the production cut-off devices 25 of the producing wells authorize the circulation of the leachate into the production manifold 15.

In a variant, all the producing wells are being treated with no producing wells being in production. For producing wells being treated, the treatment cut-off devices 27 authorize the circulation of the treatment solution, while the production cut-off devices 25 prohibit the circulation of the leachate to the production manifold 15.

With reference to FIG. 3, the cut-off devices 35 and 37 are open. The cut-off devices 41, 64, 65 and 77 are closed.

Typically, one or more injector wells are supplied with leach liquor concomitantly with the steps for supplying a treatment solution and injecting the treatment solution.

To do so, the method comprises a step of receiving the leach liquor from the supply facility 11 and supplying the leach liquor to the injector well head 3 of at least one of the injector wells via the supply manifold 9.

During this step, one or more injector wells are supplied with leach liquor, typically all injector wells are supplied with leach liquor.

The injector well(s), in the example of FIG. 3, are supplied via the supply conduits 11. The supply cut-off device(s) 13 is/are open.

In a variant, the injector wells are supplied with leach liquor, in addition to or instead of the supply conduits 11, via the supply conduits 11'.

In this case, all or part of the leach liquor is acidified by addition of acid supplied by the supply module 43.

According to another embodiment, shown in FIG. 4, at least one producing well is subjected to so-called "continuous" treatment.

Typically, several producing wells are treated, again preferably all producing wells are treated together.

In this case, the step of supplying the treatment manifold 19 with a treatment solution comprises:

receiving the leach liquor from the leach liquor supply facility 11 through the supply manifold 9, and transferring the leach liquor through the intermediate conduit 39 from the supply manifold 9 to the treatment manifold 19, the intermediate cut-off device 41 authorizing the circulation of the leach liquor in the intermediate conduit 39.

The cut-off devices 67 and 69 in this case authorize the circulation of the leach liquor. The treatment cut-off devices 27 authorize the circulation of the leach liquor in the treatment pipes 23 of the producing wells to be treated. The production cut-off devices 25 prohibit the circulation of leachate in the production pipes 21 of the producing wells to be treated.

For the producing wells not being treated, the leachate is collected and directed to the production manifold 15. In this case, the method comprises a step of collecting the leachate coming up from at least one other of the producing wells through the corresponding producing well head 5, and evacuating the leachate to the leachate treatment plant 17 via the production manifold 15.

This step is concomitant with the steps of supplying the treatment manifold with treatment solution and injecting the treatment solution into the producing well or wells to be treated.

In the operation method just described, the treatment solution corresponds to the leach liquor. According to a variant embodiment, the leach liquor used as a treatment solution is typically acidified, by adding acid from the supply module 43.

In the operation method just described, the injector wells are not supplied with leach liquor. The supply cut-off devices 13 and 13' therefore prohibit the circulation of leach liquor to the injector well heads 3. The supply module 29 is inactive. The cut-off devices 35, 37, 64, 65, 77 prohibit the circulation of fluid in the corresponding lines.

According to a variant embodiment, at least one of the injector wells is supplied with leach liquor via the supply manifold 9, concomitantly with the steps of supplying the treatment solution to the treatment manifold 19 and injecting the treatment solution into the producing well or wells.

The mining facility 1 according to the present disclosure is capable of being operated in a large number of other operating modes. Some of these will be briefly described below.

According to one operating mode, the treatment solution is supplied by the supply module 43 and is transferred to the treatment manifold 19 via the intermediate conduit 39. The injector well heads 3 are not supplied with leach liquor, as the cut-off devices 67 and 69 prohibit the circulation of leach liquor.

According to a variant of this operating mode, the injector wells 3 are supplied with leach liquor via the conduits 11. The cut-off device 69 prohibits the circulation of the leach liquor. On the other hand, the cut-off device 67 authorizes the circulation of the leach liquor.

According to another operating mode of the mining facility 1 according to the present disclosure, one or more injector wells are subject to treatment. The treatment solution is, for example, a concentrated acid solution, supplied by the treatment module 43. This concentrated acid solution is added to the leach liquor and fed to one or more injector well heads 3 via the supply conduits 11'.

In a variant, the treatment solution is directed directly to the injector well heads 3 via the supply conduits 11', without mixing with the leach liquor.

According to still another operating mode, the treatment solution for the injector well(s) is supplied by the supply module 29. It is supplied to one or more of the injector well heads 3 via the recirculation pipe 57, the bypass pipe 71 and the supply conduits 11'. In this case, the cut-off devices 35, 64, 77, 69 and 13' authorize the circulation of fluid in the corresponding lines. The cut-off devices 65 and 67, in contrast, are closed, so that the treatment solution is not mixed with the leach liquor.

In a variant, the treatment solution is mixed with the leach liquor. In this case, the treatment solution circulates through the recirculation line 57 and then through the supply manifold 9 and the supply conduits 11. The cut-off devices 35, 64, 65, 67 and 13 authorize the circulation of fluid. The cut-off devices 77 and 69 are closed.

What is claimed is:

1. An in-situ leach mining operating facility comprising:

a plurality of injector well heads each configured to inject leach liquor into a corresponding injector well;

a plurality of producing well heads each configured to selectively collect a leachate going up from the corresponding producing well or to inject a treatment solution into the corresponding producing well;

a supply manifold for supplying the injector well heads with leach liquor, the supply manifold configured to be connected on the upstream side of a facility for supplying the leach liquor, the supply manifold being fluidly connected to each injector well head;

a production manifold configured to discharge leachate to a leachate treatment plant;

a treatment manifold;

a facility for providing a treatment solution configured to inject the treatment solution into the treatment manifold and/or into the supply manifold, the facility comprising an intermediate conduit fluidly connecting the supply manifold to the treatment manifold, and equipped with an intermediate cut-off device configured for selectively authorizing or prohibiting the circulation of leach liquor in the intermediate conduit;

for each producing well, a production pipe and a treatment pipe fluidly connecting the corresponding producing well head in parallel to the production manifold and to the treatment manifold respectively, the production pipe being equipped with a production cut-off device configured for selectively authorizing or prohibiting the circulation of fluid between the producing well head and the production manifold, the treatment pipe being equipped with a treatment cut-off device configured for selectively authorizing or prohibiting the circulation of fluid between the producing well head and the treatment manifold.

2. The operating facility according to claim 1, wherein the facility for providing a treatment solution comprises a supply module for providing a treatment solution fluidly connected to the treatment manifold.

3. The operating facility according to claim 2, wherein the facility for providing a treatment solution comprises a further module for providing a treatment solution fluidly connected to the supply manifold upstream of the injector well heads.

4. The operating facility according to claim 2, wherein the supply module is movable, the treatment manifold having a detachable connection through which the movable supply module is configured for being fluidly detachably connected to the treatment manifold.

5. The operating facility according to claim 1, further comprising a recirculation conduit fluidly connected to a downstream point of the treatment manifold and to an upstream point of the supply manifold, the intermediate conduit being connected to an upstream point of the treatment manifold, the treatment pipes of the producing wells being connected to intermediate points of the treatment manifold located between the upstream and downstream points.

6. The operating facility according to claim 1, wherein the supply manifold for the injector well heads is fluidly connected to each injector well head by at least one supply conduit, the or each supply conduit being equipped with a supply cut-off device configured for selectively authorizing or prohibiting the circulation of fluid in the supply conduit.

7. A method for operating the operating facility according to claim 1 by in-situ leaching, the method comprising:

receiving the leaching liquor coming from the leaching liquor supply facility and supplying the leaching liquor to the injector well head of at least one of the injector wells via the supply manifold; and collecting the leachate going up from at least one of the producing wells through the corresponding producing well head and discharging the leachate to the leachate treatment plant through the production manifold, the treatment cut-off device prohibiting the circulation of fluid between said producing well head and the treatment manifold.

8. A method for operating the operating facility according to claim 1 by in-situ leaching, the method comprising:

supplying the treatment manifold and/or the supply manifold with a treatment solution from the facility for providing a treatment solution; and injecting the treatment solution into at least one of the producing wells and/or into at least one of the injector wells.

9. A method for operating an in-situ leach mining operating facility, the in-situ leach mining operating facility comprising:

a plurality of injector well heads each configured to inject leach liquor into a corresponding injector well;

a plurality of producing well heads each configured to selectively collect a leachate going up from the corresponding producing well or to inject a treatment solution into the corresponding producing well;

a supply manifold for supplying the injector well heads with leach liquor, the supply manifold configured to be connected on the upstream side of a facility for supplying the leach liquor, the supply manifold being fluidly connected to each injector well head;

a production manifold configured to discharge leachate to a leachate treatment plant;

a treatment manifold;

a facility for providing a treatment solution configured to inject the treatment solution into the treatment manifold and/or into the supply manifold, wherein the facility for providing a treatment solution comprises a supply module for providing a treatment solution fluidly connected to the treatment manifold, the supply module being fluidly connected to the treatment manifold and supplying the treatment solution;

for each producing well, a production pipe and a treatment pipe fluidly connecting the corresponding producing well head in parallel to the production manifold and to the treatment manifold respectively, the production pipe being equipped with a production cut-off device configured for selectively authorizing or prohibiting the circulation of fluid between the producing well head and the production manifold, the treatment pipe being equipped with a treatment cut-off device configured for selectively authorizing or prohibiting the circulation of fluid between the producing well head and the treatment manifold;

the method for operating the operating facility comprising:

supplying the treatment manifold and/or the supply manifold with a treatment solution from the facility for providing a treatment solution; and injecting the treatment solution into at least one of the producing wells and/or into at least one of the injector wells.

10. A method for operating an in-situ leach mining operating facility, the in-situ leach mining operating facility comprising:

a plurality of injector well heads each configured to inject leach liquor into a corresponding injector well;

a plurality of producing well heads each configured to selectively collect a leachate going up from the corresponding producing well or to inject a treatment solution into the corresponding producing well;

a supply manifold for supplying the injector well heads with leach liquor, the supply manifold configured to be connected on the upstream side of a facility for supplying the leach liquor, the supply manifold being fluidly connected to each injector well head;

a production manifold configured to discharge leachate to a leachate treatment plant;

a treatment manifold;

a facility for providing a treatment solution configured to inject the treatment solution into the treatment manifold and/or into the supply manifold;

for each producing well, a production pipe and a treatment pipe fluidly connecting the corresponding producing well head in parallel to the production manifold and to the treatment manifold respectively, the production pipe being equipped with a production cut-off device configured for selectively authorizing or prohibiting the circulation of fluid between the producing well head and the production manifold, the treatment pipe being equipped with a treatment cut-off device configured for selectively authorizing or prohibiting the circulation of fluid between the producing well head and the treatment manifold;

the method for operating the operating facility comprising:

supplying the treatment manifold and/or the supply manifold with a treatment solution from the facility for providing a treatment solution; and injecting the treatment solution into at least one of the producing wells and/or into at least one of the injector wells, wherein:

in the supplying step, the treatment solution is supplied to the treatment manifold; and in the injection step, the treatment solution is injected into at least one producing well, the production cut-off device prohibiting the circulation of fluid between the corresponding producing well head and the production manifold, the treatment cut-off device authorizing the circulation of the treatment solution from the treatment manifold to the corresponding producing well head.

11. The operation method according to claim 10, wherein the facility for providing a treatment solution comprises an intermediate conduit, fluidly connecting the supply manifold to the treatment manifold, and equipped with an intermediate cut-off device configured for selectively authorizing or prohibiting the circulation of leach liquor in the intermediate conduit, the step of providing a treatment solution comprising:

receiving the leach liquor coming from the leach liquor supply facility through the supply manifold, and transferring all or part of the leach liquor through the intermediate conduit from the supply manifold to the treatment manifold, the intermediate cut-off device authorizing the circulation of the leach liquor through the intermediate conduit.

12. The operation method according to claim 10, further comprising receiving the leach liquor from the leach liquor supply facility and supplying leach liquor to the injector well head of at least one of the injector wells via the supply manifold, concomitant with the steps of supplying the treatment solution and injecting the treatment solution.

13. The operation method according to claim 10, further comprising collecting leachate going up from at least one other of the producing wells through the corresponding producing well head and discharging the leachate to the leachate treatment plant through the production manifold, concomitant with the steps of supplying the treatment solution and injecting the treatment solution.

* * * * *